United States Patent [19]

Ireland et al.

[11] 4,052,477

[45] Oct. 4, 1977

[54] METHOD FOR UPGRADING A FISCHER-TROPSCH LIGHT OIL

[75] Inventors: Henry R. Ireland, Woodbury; Alan W. Peters; Thomas R. Stein, both of Cherry Hill, all of N.J.

[73] Assignee: Mobil Oil Corporation, New York, N.Y.

[21] Appl. No.: 684,511

[22] Filed: May 7, 1976

[51] Int. Cl.[2] ..... C07C 1/02

[52] U.S. Cl. ..... 260/676 R; 208/57; 208/64; 208/79; 208/88; 208/93; 260/449 R; 260/450

[58] Field of Search ..... 260/676 R, 449 R, 449 M, 260/449.5, 449.6, 450; 208/57, 64, 79, 88, 93

[56] References Cited

U.S. PATENT DOCUMENTS

| | | | |
|---|---|---|---|
| 2,740,804 | 4/1956 | Glazier | 260/450 |
| 2,752,382 | 6/1956 | Garrett et al. | 260/450 |
| 3,172,842 | 3/1965 | Paterson | 208/79 |
| 3,700,585 | 10/1972 | Chen et al. | 208/111 |
| 3,729,409 | 4/1973 | Chen | 208/135 |
| 3,760,024 | 9/1973 | Cattanach | 260/673 |
| 3,843,510 | 10/1974 | Morrison et al. | 208/111 |
| 3,928,483 | 12/1975 | Chang et al. | 260/668 R |
| 3,960,978 | 6/1976 | Givens et al. | 260/683.15 R |

OTHER PUBLICATIONS

Asinger, *Paraffins Chemistry & Technology*, Pergammon Press, N. Y. (1968) pp. 3, 123–125, 131, 132, 136, 138.

*Primary Examiner*—C. Davis

*Attorney, Agent, or Firm*—Charles A. Huggett; Carl D. Farnsworth

[57] ABSTRACT

The product of Fischer-Tropsch Synthesis is separated to recover a $C_5$-400° F liquid fraction which is thereafter hydrogenated in order to saturate diolefins and contacted with a ZSM-5 type zeolite under conditions of elevated temperature and pressure so as to obtain gasoline of a higher octane rating. The contact with the ZSM-5 zeolite is preferably in the presence of added hydrogen.

12 Claims, 1 Drawing Figure

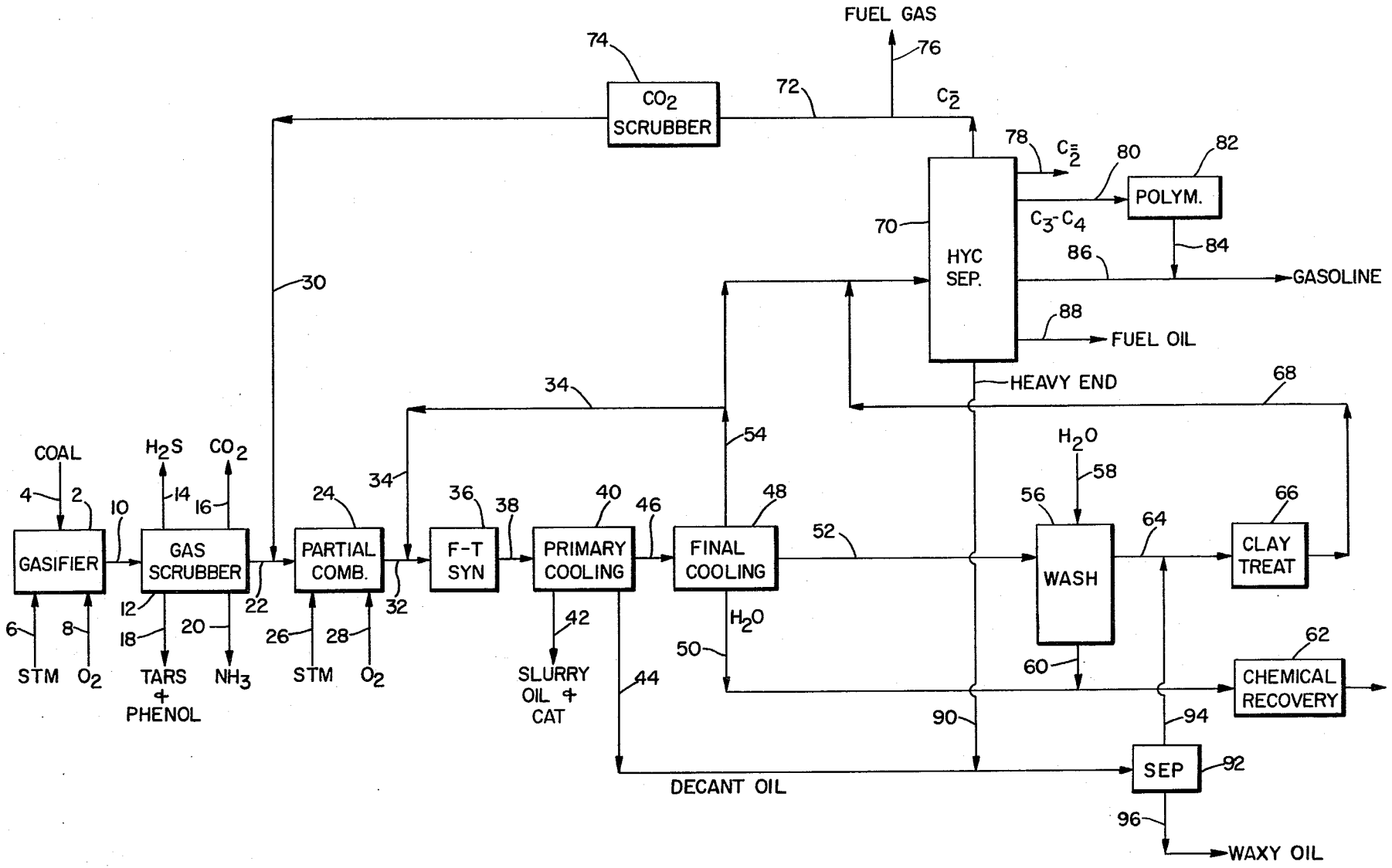
COAL
GASIFIER
STM
$O_2$
GAS SCRUBBER
$H_2S$
$CO_2$
$NH_3$
TARS + PHENOL
PARTIAL COMB.
STM
$O_2$
F-T SYN
PRIMARY COOLING
SLURRY OIL + CAT
FINAL COOLING
$H_2O$
$CO_2$ SCRUBBER
FUEL GAS
HYC SEP.
$C_2^=$
$C_3^=-C_4$
POLYM.
GASOLINE
FUEL OIL
HEAVY END
$H_2O$
WASH
CLAY TREAT
CHEMICAL RECOVERY
SEP
WAXY OIL
DECANT OIL

METHOD FOR UPGRADING A FISHER-TROPSCH LIGHT OIL

BACKGROUND OF THE INVENTION

1. Field of the Invention

This invention is concerned with a process for converting synthesis gas, i.e., mixtures of gaseous carbon oxides with hydrogen or hydrogen donors, to hydrocarbon mixtures and oxygenates. More particularly, this invention is concerned with upgrading a $C_5+$ fraction having an end point of 340° up to 400° F obtained in a known Fischer-Tropsch Synthesis process, so as to obtain a high yield of $C_5+$ gasoline of enhanced octane.

2. Other Prior Art

Processes for the conversion of coal and other hydrocarbons such as natural gas to a gaseous mixture consisting essentially of hydrogen and carbon monoxide, or of hydrogen and carbon dioxide, or of hydrogen and carbon monoxide and carbon dioxide, are well known. Although various processes may be employed for the gasification, those of major importance depend either on the partial combustion of the fuel with an oxygen-containing gas or on a combination of these two reactions. An excellent summary of the art of gas manufacture, including synthesis gas, from solid and liquid fuels, is given in "Encyclopedia of Chemical Technology," edited by Kirk-Othmer Second Edition, Volume 10, pages 353–433, (1966), Interscience Publishers, New York, N.Y., the contents of which are herein incorporated by reference. The techniques for gasification of coal or other solid, liquid or gaseous fuel are not considered to be per se inventive here.

It is considered desirable to effectively and more efficiently convert synthesis gas, and thereby coal and natural gas, to highly valued hydrocabons such as motor gasoline with high octane number, petrochemical feedstocks, liquefiable petroleum fuel gas, and aromatic hydrocarbons. It is well known that synthesis gas will undergo conversion to form reduction products of carbon monoxides such as hydrocarbons at from about 300° to about 850° F under from about one to one thousand atmospheres pressure, over a fairly wide variety of catalysts. The Fischer-Tropsch process, for example, which has been most extensively studied, produces a range of products including liquid hydrocarbons, a portion of which have been used as low octane gasoline. The types of catalysts that have been studied for this and related processes include those based on metals or oxides of iron, cobalt, nickel, ruthenium, thorium, rhodium and osmium.

The wide range of catalysts and catalysts modifications disclosed in the art and an equally wide range of conversion conditions for the reduction of carbon monoxide by hydrogen provide considerable flexibility toward obtaining selected boiling-range products. Nonetheless, in spite of this flexibility it has not proved possible to make such selections so as to produce liquid hydrocarbons in the gasoline boiling range which contain highly branched paraffins and substantial quantities of aromatic hydrocarbons, both of which are required for high quality gasoline, or to selectivity produce aromatic hydrocarbons particularly rich in the benzene to xylene range. A review of the status of this art is given in "Carbon Monoxide-Hydrogen Reactions," *Encyclopedia of Chemical Technology,* Edited by Kirk-Othmer, Second Edition, Volume 4, pp. 446–488, Interscience Publishers, New York, N.Y., the text of which is incorporated herein by reference.

Recently, it has been discovered that synthesis gas may be converted to oxygenated organic compounds and these then converted to higher hydrocarbons, particularly high octane gasoline, by catalytic contact of the synthesis gas with a carbon monoxide reduction catalyst followed by contacting the conversion products so produced with a special class of crystalline zeolite catalyst in a separate reaction zone. This two-stage conversion is described in a copending United States patent application, Ser. No. 387,220, filed Aug. 9, 1973. Compositions of iron, cobalt or nickel deposited in the inner absorption regions of crystalline zeolites are described in U.S. Pat. No. 3,013,990. Attempts to convert synthesis gas over X-zeolite base exchanged with iron, cobalt and nickel are described in Erdol and Kohle - Erdgas, Petrochemie: Brennstoff - Chemie; Vol. 25, No. 4, pp. 187–188, April 1972.

SUMMARY OF THE INVENTION

This invention is concerned with improving the product distribution and yield of products obtained by a Fischer-Tropsch synthesis gas conversion process. In a particular aspect, the present invention is concerned with upgrading the $C_5$-400° F liquid fraction of a synthesis gas conversion operation known in the industry as the Sasol Synthol process.

The Sasol process, located in South Africa, and built to convert an abundant supply of poor quality coal and products thereof to particularly hydrocarbons, oxygenates and chemical forming components was a pioneering venture. The process complex developed is enormous, expensive to operate and may be conveniently divided or separated into (1) a synthesis gas preparation complex from coal, (2) a Fischer-Tropsch type of synthesis gas conversion in both a fixed catalyst bed operation and a fluid catalyst bed operation, (3) a product recovery operation and (4) auxillary plant and utility operations required in such a complex.

The extremely diverse nature of the products obtained in the combination operation of the Sasol process amplifies the complexity of the overall process complex, its product recovery arrangement and its operating economics. The Sasol synthesis operation is known to produce a wide spectrum of products including fuel gas, light olefins, LPG, gasoline, light and heavy fuel oils, waxy oils and oxygenates identified as alcohols, acetone, ketones and acids particularly acetic and propionic acid. The $C_2$ and lower boiling components may be reformed to carbon monoxide and hydrogen or the $C_2$ formed hydrocarbons and methane may be combined and blended for use in a fuel gas pipeline system.

In the Sasol operation, the water-soluble chemicals are recovered as by steam stripping distillation and separated into individual components with the formed organic acids remaining in the water phase separately treated. Propylene and butylene formed in the process are converted to gasoline boiling components as by polymerization in the presence of a phosphoric acid catalyst and by alkylation. Propane and butane on the other hand are used for LPG.

The present invention is concerned with improving a Fischer-Tropsch synthesis gas conversion operation and is particularly directed to improving the synthetic gasoline product selectivity and quality obtained by processing $C_5$-400° F material over a special class of crystalline zeolite represented by ZSM-5 crystalline zeolite. It has been found that improved benefits can be obtained with regard to processing said $C_5$-400° F material over a ZSM-5 type zeolite if said material is subjected to a mild hydrogenation treatment in order to selectively saturate diolefins inherently contained therein without significantly effecting its monoolefin content. It has been found that a treatment of this type greatly enhances the subsequent catalytic conversion in that it allows for a longer cycle time, thereby minimizing the frequency at which the catalyst must be regenerated. The conversion with the ZSM-5 type zeolite can be carried out either with our without added hydrogen. More particularly, the present invention is concerned with improving the yield of $C_5$+ gasoline of enhanced octane from a Fischer-Tropsch syngas conversion operation.

DESCRIPTION OF THE DRAWING

The single FIGURE is a condensed, schematic, block flow arrangement of a known Fischer-Tropsch syngas conversion process directed to the conversion of coal to synthesis gas comprising carbon monoxide and hydrogen and the reduction of carbon monoxide by the Fischer-Tropsch Process to form a product mixture comprising hydrocarbon and oxygenates and the recovery of these products for further use.

Referring now to the FIGURE, there is shown in block flow arrangement a substantially reduced process flow arrangement of the Sasol syngas conversion process. A coal gasifier section 2 is provided to which pulverized coal is introduced by conduit 4, steam by conduit 6 and oxygen by conduit 8. The products of gasifier section 2 are then passed by conduit 10 to a gas scrubber section 12. In scrubber section 12, carbon monoxide and hydrogen-producing gases are separated from hydrogen sulfide which is removed by conduit 14, carbon dioxide removed by conduit 16, tars and phenols removed by conduit 18 and ammonia removed by conduit 20. The carbon monoxide-hydrogen producing gas is passed from section 12 by conduit 22 to a partial combustion zone 24 supplied with steam by conduit 26 and oxygen by conduit 28. Recycle $C_2$ fuel gas product of the combination process after separation of carbon dioxide therefrom is recycled by conduit 30 to the partial combustion section 24. In the partial combustion operation 24, a suitable carbon monoxide-hydrogen rich synthesis gas of desired ratio is formed for use in a downstream Fischer-Tropsch synthesis gas conversion operation.

The Sasol process operates two versions of the Fischer-Tropsch process; one being a fixed catalyst bed operation and the other being a fluid catalyst bed operation. Each of these operations use iron catalyst prepared and presented to obtain desired catalyst composition and activity. The synthesis gas prepared as above briefly identified is passed by conduit 32 to the Fischer-Tropsch reaction section 36 in admixture with recycle gas introduced at a temperature of about 160° C and at an elevated pressure of about 365 psig. The temperature of the synthesis gas admixed with catalyst in the fluid operation rapidly rises by the heat liberated so that the Fischer-Tropsch and water gas shift reactions take place. The products of the Fischer-Tropsch synthesis reaction are conveyed by conduit 38 to a primary cooling section 40 wherein the temperature of the mixture is reduced to within the range of 280° to about 400° F. In a primary cooling section, a separation is made which permits the recovery of a slurry oil and catalyst stream by conduit 42, and a decant oil stream by conduit 44. In one typical operation, the decant oil stream will have an ASTM 95% boiling point of about 900° F. A light oil stream boiling below about 560° F and lower boiling components including oxygenates is passed by conduit 46 to a second or final cooling and separating section 48. In cooling section 48, a separation is made to recover a water phase comprising water-soluble oxygenates and chemicals withdrawn by conduit 50, a relatively light hydrocarbon phase boiling below about 560° F withdrawn by conduit 52 and a normally vaporous phase withdrawn by conduit 54. A portion of the vaporous phase comprising unreacted carbon monoxide and hydrogen is recycled by conduit 34 to conduit 32 charging syngas to the Fischer-Tropsch synthesis operation. In a typical operation, about one volume of fresh feed is used with two volumes of recycle gas. The hydrocarbons do not completely condense and an absorber system is used for their recovery. Methane and $C_2$ hydrocarbons are blended with other components in a pipeline system or they are passed to a gas reforming section for recycle as feed gas in the synthesis operation. The light hydrocarbon phase in conduit 52 is then passed through a water wash section 56 provided with wash water by conduit 58. In wash section 56, water-soluble materials comprising oxygenates are removed and withdrawn therefrom by conduit 60. The water phases in conduits 50 and 60 are combined and passed to a complicated and expensive-to-run chemicals recovery operation 62. The washed light hydrocarbon phase is removed by conduit 64 and passed to a clay treater 66 along with hydrocarbon fraction boiling below about 650° F recovered from the decanted oil phase in conduit 44 and a heavy oil product fraction recovered as hereinafter described. The hydrocarbon phase thus recovered and passed to this clay treating section is preheated to an elevated temperature of above about 600° F or higher before contacting the catalyst or clay in the treater. This clay treatment isomerizes hydrocarbons and particularly the alpha olefins in the product thereby imparting a higher octane rating to these materials. The treatment also operates to convert harmful acids and other oxygenates retained in the hydrocarbon phase after the water wash. The clay treated hydrocarbon product is passed by conduit 68 to a hydrocarbon separation reaction 70. A portion of the hydrocarbon vapors in conduit 54 not directly recycled to the Fischer-Tropsch conversion operation by conduit 34 is also passed to the hydrocarbon separation reaction 70. In the hydrocarbon separation section 70, a separation is made to recover a fuel gas stream comprising $C_2$ hydrocarbons withdrawn by conduit 72. A portion of this material is passed through a $CO_2$ scrubber 74 before recycle by conduit 30 to the partial combustion zone 24. A portion of the fuel gas may be withdrawn by conduit 76. In separation section 70, a $C_2$ olefin rich stream is recovered by conduit 78 for chemical processing as desired. A $C_3$ to $C_4$ hydrocarbon stream rich in olefins is withdrawn by conduit 80 and passed to catalytic polymerization in section 82. Polymerized material suitable for blending with gasoline product is withdrawn by conduit 84. A $C_5$+ gasoline product fraction having an end point in the range of 340° to 360° up to 400° F is recovered by conduit 86 and a light fuel oil product such as No. 2 fuel oil is withdrawn by conduit 90 for admixture with the decant oil fraction in conduit 44 as mentioned above. The blend of hydrocarbons product thus formed will boil in the range of about 400° to about 1000° F.

This material blend is passed to a separator section 92 wherein a separation is made to recover a fraction boiling in the range of from about 400° to 650° F withdrawn by conduit 44 from a heavier higher boiling waxy oil withdrawn by conduit 96.

In this relatively complicated synthesis gas conversion operation and product recovery, it is not unusual to recover a product distribution comprising 2% ethylene, 8% LPG, 70% gasoline boiling material, 3% fuel oil, 3% waxy oil and about 14% of materials defined as oxygenates.

This Fischer-Tropsch synthesis operation above briefly defined and known in the industry as the Sasol synthos process can be significantly improved following the concepts of this invention. It is the purpose of the invention to substantially upgrade the $C_5$-340° to 400° F gasoline fraction (i.e. the product from conduit 86 prior to blending via conduit 84) by pretreatment of the same with hydrogen in the presence of an active hydrogenation catalyst such as platinum or palladium deposited on an inorganic oxide base such as alumina and thereafter contacting the same with a special type of crystalline aluminosilicate zeolite catalyst. The gasoline fraction thus obtained will contain from about 10 to 100 ppm of sulfur.

The special zeolite catalysts referred to herein utilize members of a special class of zeolite exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e., high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A types. Furthermore, carbonaceous deposits, when formed, may be removed by burning at higher than usual temperatures to restore activity. In many environments, the zeolites of this class exhibit very low coke forming capability conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminoslicate, the oxygen atoms themselves being bonded to the silicon or aluminum atoms at the centers of the tetrahedra. Briefly, the preferred zeolites useful as catalysts in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intra-crystalline sorption capacity for normal hexane which is greater than that for water, i.e. they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of twelve-membered rings to not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F for at least 15 minutes. The zeolite is then flushed with helium and the temperature adjusted between 550° F and 950° F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbons mole ratio of 4:1. After 20 minutes on stream, a sample of the effluent is taken and analyzed, most conveniently by gas chromatography, to determine the fraction remaining unchanged for each of the two hydrocarbons.

The constraint index is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) valus for some typical zeolites including some not within the scope of this invention are:

| CAS | C.I. |
|---|---|
| ZSM-5 | 8.3 |
| ZSM-11 | 8.7 |

-continued

| CAS | C.I. |
|---|---|
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-alumina | 0.6 |
| Erionite | 38 |

The above-described Constraint Index is an important and even critical definition of those zeolites which are useful to catalyze the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above-defined range of 1 to 12.

Thus, it should be understood that the "Constraint Index" value as used herein is an inclusive rather than an exclusive value. That is, a zeolite when tested by any combination of conditions within the testing definition set forth hereinabove to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. Application Ser. No. 358,192, filed May 7, 1973 the entire contents of which are incorporated herein by reference, describes a zeolite composition, and a method of making such, designated as ZSM-21 which is useful in this invention.

U.S. Application Ser. No. 528,061, filed Nov. 29, 1974, the entire contents of which are incorporated herein by reference, described a zeolite composition including a method of making it. This composition is designated ZSM-35 and is useful in this invention.

U.S. Application Ser. No. 528,060, filed Nov. 29, 1974, the entire contents of which are incorporated herein by reference, describes a zeolite composition including a method of making it. This composition is designated ZSM-38 and is useful in this invention.

The X-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000° F for 1 hour, for example, followed by base exchange with ammonium salts followed by calcination at 1000° F in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000° F for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April, 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gemlinite | .44 | 1.46 |
| Chabazite | .47 | 1.45 |
| A | .5 | 1.3 |
| Y | .48 | 1.27 |

As has heretofore been stated, the most preferred form of the specific, previously defined zeolites in carrying out the novel process of this invention is the hydrogen form. As acid form is well known in the art, the hydrogen form can be made by base exchanging the particular zeolite with hydrogen ions or ions capable of conversion to hydrogen ions, i.e. ammonium ions.

The crystalline zeolite compositions can also be admixed with a non-acidic inorganic binder, such as alumina in order to impart the desired properties to the zeolite, such as increased strength and attrition resistance. Quite obviously, the proportion of binder employed is not narrowly critical, and it has been found convenient to use compositions where the binder is present from about 10 to 70% and preferably 30–40% based on the total weight of the zeolite plus binder.

Pre-treatment of the $C_5$-400 stream in order to selectively saturate the diolefins and to isomerize terminal olefins to less reactive internal olefins is conveniently carried out by contacting the same in the presence of added hydrogen with an active hydrogenation component which is preferably combined with a mildly acidic oxide carrier. Although the nature of the hydrogenation step is not narrowly critical, nevertheless, certain precautions must be taken in order to insure maximum benefits from said treatment. In the first place, the purpose of the hydrogenation treatment is to saturate the diolefins which are inherently contained in the $C_5$-400 stream without substantially effecting the monoolefins, and in this connection, the reaction must be carried out at relatively low temperatures. It would appear that if high temperatures are employed there is a possibility that the monoolefins contained in the $C_5$-400 stream would be saturated or that other unfavorable reactions would occur. Accordingly, it is preferred to operate within the temperature range of from 50° to 450° with a temperature of from 100° to 400° being preferred. In order to be able to operate at these relatively low temperatures, a hydrogenation component must be used which is active at these temperatures, and in this connection, it has been found that the platinum group metals, particularly platinum and/or palladium are particularly suitable.

In view of the fact that it is only desired to saturate the diolefins without substantially affecting the $C_5$-400 feed in any other way, any support upon which the hydrogenation catalyst is deposited should not be an active cracking catalyst. The support should be substantially inert at the conditions chosen for hydrogenation, and in this connection, an inert base such as alumina is preferred.

The novel process of this invention is carried out by contacting the $C_5$+ liquid gasoline fraction having an end point of from 340° up to about 400° F, and preferably, a $C_5$-400° F fraction with the zeolites previously described at elevated temperatures either with or without added hydrogen and recovering a product which has been upgraded with respect to its octane number and its alkyl aromatic content.

The pressure at which the reaction is carried out is not narrowly critical and pressures ranging from atmospheric psig to 700 psig and preferably, from 300–600 psig, are conveniently employed.

The temperature at which the reaction is carried out ranges from about 575° to 850° F although it is preferred to operate around 600°–700° F.

A particularly preferred embodiment of the novel process of this invention resides in having a hydrogenation/dehydrogenation material associated with the crystalline aluminosilicate zeolite. In this connection, it has been found that the presence of a hydrogenation metal prolongs catalyst life and leads to more efficient and desirable operation. A typical hydrogenation component would include tungsten, vanadium, molybdenum, rhenium, nickel, cobalt, chromium, manganese, platinum, palladium, etc. including compounds thereof.

The manner in which the hydrogenation component is associated with the zeolite is not critical. It can be base exchanged into the zeolite or impregnated therein or physically intimately admixed therewith. The most preferred catalyst for carrying out the novel process of this invention is a nickel and acid exchanged ZSM-5 which is admixed with about 30–35% by weight of an alumina binder and thereafter presulfided. It is also preferred to presulfide any of the other hydrogenation components employed in the catalyst arrangement described.

The following examples illustrate the best mode now contemplated for carrying out the invention.

EXAMPLES 1–3

In the examples which follow, comparisons were made between processing a $C_5$-400° F liquid fraction comprising about 30 ppm sulfur resulting from a Fischer-Tropsch synthesis over a nickel and acid exchanged ZSM-5 zeolite composited with sufficient alumina such that the alumina represented about 35 weight percent of the total composite, the composite catalyst being presulfided before use.

Example 1 represents treatment of said $C_5$-400° F fraction without any pre-treatment whatsoever. As will be seen from the table which follows, the catalyst had a cycle life of about 16 days.

Example 2 represents the results obtained from regenerating the catalyst from Example 1 after it had become deactivated by means of a hydrogen treatment and thereafter processing the same $C_5$-400° F feedstock over said regenerated catalyst.

In Example 3, the charge stock was first pre-treated with a palladium on alumina hydrogenation catalyst which had been presulfided and the total effluent then contacted with the same acid and nickel ZSM-5 catalyst also presulfided as used in Example 1.

The results obtained in Examples 1, 2 and 3 contacted with the specific operating conditions are shown in the following table.

TABLE

Comparison of Cycle Life and Preheater Plugging With and Without Charge Stock Preheating of $C_5$–400° F Synthol Before Processing over H-NiZSM-5*

| Example | | 1 | 2 | 3 |
|---|---|---|---|---|
| Type of Operation | | No Pretreat | No Pretreat | After Pretreat ($Pd/Al_2O_3$) + |
| Time on Stream, Hrs. | | 36 | 24 (After $H_2$Reg) | 876 |
| Process Conditions | | | | |
| WHSV, Wt/Hr/Wt | | 2.0 | 2.0 | 2.0 |
| Pressure, psig | | 400 | 400 | 400 |
| Temperature, ° F. | | 625 | 611 | 660 |
| Hydrogen Circulation, SCF/B | | 2656 | 2885 | 2715 |
| Expected Cycle Life, Days | | 16 | (Preheater Plug) | 120 |
| Hydrogen Consumption, SCF/d | | 383 | 164 | 432 |
| Yields, Wt. % on Oil Charge | | | | |
| | Charge | | | |
| $H_2O$ | | 2.59 | 2.59 | 1.60 |
| $H_2$ | | −0.82 | −0.33 | −.86 |
| $C_1 + C_2$ | | 0.30 | 0.29 | .57 |
| $C_3$ | | 4.75 | 1.93 | 5.58 |
| $C_3 =$ | | 0.02 | 0.19 | 0.48 |
| $nC_4$ | 0.03 | 4.08 | 1.65 | 2.21 |
| $iC_4$ | | 5.57 | 2.05 | 1.46 |
| $C_4 =$ | 0.16 | 1.35 | 2.50 | 4.07 |
| $nC_5$ | 1.92 | 3.25 | 1.85 | 1.28 |
| $iC_5$ | 0.13 | 5.19 | 2.35 | 1.35 |
| $C_5 =$ | 22.50 | 1.35 | 3.94 | 7.88 |
| Cyclic $C_5$ | 0.21 | 0.19 | 0.06 | 0.00 |
| $C_6 +$ | 75.10 | 72.16 | 80.93 | 74.37 |
| Total | 100.00 | 100.00 | 100.00 | 100.00 |
| $C_5 +$ Product Properties | | | | |
| RON + O | 59 | 82.9 | 86.0 | 90.3 |
| RON + 3TEL | 71 | 94.0 | 94.3 | |
| MON + 0 | 54 | 77.9 | 77.4 | 78.9 |
| MON + 3 TEL | 68 | 88.2 | — | |
| Acid Number | 3.5 | <0.05 | <0.05 | <0.05 |
| P/O/N/A Vol% | 31/56/4/9 | 40/20/17/23 | 36/33/12/19 | 24/58/5/13 |

*Catalysts reduced with hydrogen at 800° F at 500 psig and presulfided with 2% $H_2$//98% $H_2$ at 500 psig and 450–650° F.

As can be seen from the above table, operations in accordance with the process of this invention extended the cycle life to 120 days thereby demonstrating the particular improvement of the process recited in each of the claims.

What is claimed is:

1. A method for upgrading the $C_5+$ liquid product of a Fischer-Tropsch synthesis having an end point from about 340°–400° F which comprises hydrogenating said liquid in the presence of a hydrogenation catalyst component at conditions of temperature and pressure so as the selectively hydrogenate substantially only the diolefins contained therein and thereafter contacting said liquid at a temperature within the range of about 575° to about 850° F and at a pressure within the range of from about atmospheric to 700 psig with a crystalline aluminosilicate catalyst component characterized by a pore dimension greater than about 5 Angstroms, a silica to alumina ratio of at least 12, and a constraint index within the range of 1:12 said catalyst being presulfided prior to use, and recovering a gasoline boiling range product having an enhanced octane number.

2. The process of claim 1, wherein the hydrogenation component comprises platinum or palladium.

3. The process of claim 2, wherein the hydrogenation is carried out at a temperature of from 100° to 400° F.

4. The process of claim 1, wherein the crystalline aluminosilicate zeolite has been exchanged with hydrogen ions or ammonium ions.

5. The process of claim 4, wherein a hydrogenation/-dehydrogenation component is associated with the crystalline aluminosilicate and contact therewith is in the presence of added hydrogen.

6. The process of claim 5, wherein the hydrogenation/dehydrogenation component is nickel.

7. A method for upgrading the $C_5+$ liquid fraction of a Fischer-Tropsch synthesis comprising sulfur having an end point of from about 340°–400° F, which comprises hydrogenating said $C_5+$ liquid by contact with a presulfided hydrogenation catalyst comprising platinum or palladium at a temperature of 100° to 400° F and a pressure of 50 to 800 psig so as to selectively hydrogenate only the diolefins contained therein and thereafter contacting said selectively hydrogenated liquid at a temperature of 575°–850° F and a pressure of from about atmospheric to 700 psig with a crystalline aluminosilicate zeolite selected from the group consisting of ZSM-5, ZSM-11, ZSM-12, ZSM-21, ZSM-35, and ZSM-38 and recovering a gasoline boiling range product having an enhanced octane number.

8. A process of claim 7, wherein the crystalline aluminosilicate zeolite has been base exchanged with hydrogen ions or ammonium ions.

9. The process of claim 8, wherein the crystalline aluminosilicate has a hydrogenation/dehydrogenation component associated therewith in sulfided condition and contact therewith is in the presence of added hydrogen.

10. The process of claim 7, wherein the zeolite is ZSM-5.

11. The process of claim 9, wherein the zeolite is ZSM-5 which has nickel associated therewith and is composited with an inorganic oxide binder.

12. The process of claim 11, wherein the binder is alumina.

* * * * *